US007236711B2

(12) United States Patent
Burry et al.

(10) Patent No.: US 7,236,711 B2
(45) Date of Patent: Jun. 26, 2007

(54) FULL-WIDTH ARRAY SENSING OF TWO-DIMENSIONAL RESIDUAL MASS STRUCTURE TO ENABLE MITIGATION OF SPECIFIC DEFECTS

(75) Inventors: Aaron M. Burry, West Henrietta, NY (US); Christopher A. Dirubio, Webster, NY (US); Gerald M. Fletcher, Pittsford, NY (US); Eric S. Hamby, Fairport, NY (US); Martin Krucinski, Webster, NY (US); Robert J. Mead, Hamlin, NY (US); Bruce J. Parks, Bloomfield, NY (US); Peter Paul, Webster, NY (US); Palghat S. Ramesh, Pittsford, NY (US); Eliud Robles Flores, Webster, NY (US); Fei Xiao, Penfield, NY (US)

(73) Assignee: Xerox Corporation, Stamford, CT (US)

( * ) Notice: Subject to any disclaimer, the term of this patent is extended or adjusted under 35 U.S.C. 154(b) by 329 days.

(21) Appl. No.: 11/094,454

(22) Filed: Mar. 31, 2005

(65) Prior Publication Data

US 2006/0222387 A1 Oct. 5, 2006

(51) Int. Cl.
*G03G 15/00* (2006.01)

(52) U.S. Cl. ..... 399/49; 399/60; 399/129

(58) Field of Classification Search ..... 399/38, 399/42, 46, 49, 60, 107, 127, 129
See application file for complete search history.

(56) References Cited

U.S. PATENT DOCUMENTS 5,360,940 A 11/1994 Hays
5,543,896 A 8/1996 Mestha
5,887,221 A 3/1999 Grace
5,903,797 A 5/1999 Daniels et al.
6,272,295 B1 8/2001 Lindblad et al.
6,694,109 B1 2/2004 Donaldson et al.
7,054,568 B2 * 5/2006 Mizes et al. ..... 399/49
7,146,123 B2 * 12/2006 Kidaka ..... 399/129

OTHER PUBLICATIONS

Chunhui Zhong; "Bayesian Belief Network Modeling and Diagnosis of Xerographic Systems"; Department of Mechanical Engineering, University of Minnesota; date unknown but prior to Mar. 31, 2005.

* cited by examiner

*Primary Examiner*—Hoan Tran
(74) *Attorney, Agent, or Firm*—Oliff & Berridge, PLC

(57) ABSTRACT

A defect analysis system for a xerographic print engine includes a residual mass sensor that senses the two-dimensional signature structure of residual mass remaining on a photoconductive or other substrate surface after image transfer. Preferably, the sensor is a full width array that spans substantially an entire width of the photoconductive surface. This information is then processed and analyzed to determine a specific type of transfer defect present. This may include the quantified level of defect for each detected type. The defect analysis system may also include a closed-loop control system that can adjust various xerographic process parameters using feedback based on the identification and optionally magnitude of each specific defect type. The identified print quality defect, such as mottle, streaks, point deletions, graininess, etc. can then be used to determine a customized corrective control action to be taken by the feedback control of the xerographic print engine to remedy or compensate for the defect(s).

20 Claims, 8 Drawing Sheets

FULL-WIDTH ARRAY SENSING OF TWO-DIMENSIONAL RESIDUAL MASS STRUCTURE TO ENABLE MITIGATION OF SPECIFIC DEFECTS

BACKGROUND

Sensing of two-dimensional residual mass structure on a photoreceptor after transfer is used to identify specific types of transfer defects. Upon identification, closed-loop control of the transfer process can be performed taking into account the identified defect types, as well as their magnitudes, to correct or compensate for the defects.

The use of sensors to detect the toner mass levels on a photoreceptor, or other substrate, in a post-development position (detection of developed mass) in a xerographic engine is known. For example, see U.S. Pat. No. 5,887,221 to Grace; and U.S. Pat. No. 5,543,896 to Mestha; and U.S. Pat. No. 6,694,109 to Donaldson et al. The use of sensors to detect residual toner mass levels post-cleaning device is also known. For example, see U.S. Pat. No. 6,272,295 to Lindblad et al. and U.S. Pat. No. 5,903,797 to Daniels et al. It is also known to measure the residual mass after transfer but before the cleaning device (post transfer residual mass).

Previous post-transfer residual mass sensors have provided information about the average transfer efficiency and could enable limited closed loop control of the transfer system. For example, some teach use of an Extended Toner Area Coverage (ETAC) sensor to measure residual mass per unit area (RMA) during xerographic setup. The data from the sensor in this case is used to adjust the transfer shield current setpoint to obtain optimal performance prior to the submission of the customer's job.

The information provided by measuring the RMA with a point sensor like an ETAC is limited to an average measurement of transfer performance. In addition, because a point sensor typically only measures the transfer efficiency at one isolated location in the cross process direction, variations that occur across the belt are not captured by this type of sensor. Therefore, typical ETAC sensors provide only minimal information that is relevant to control of the transfer performance.

To overcome this problem, subsequent implementations have used sensors containing arrays of optical sensing elements. In many of these devices, the array of sensing elements provides information across the entire surface of the photoconductor or other substrate of interest. Such optical sensing array devices are termed full-width array (FWA) sensors. These FWA sensors have been used for measuring RMA across all or a majority of the photoreceptor surface. This method eliminated concerns of the point-sensing nature of ETAC RMA sensors because the residual mass content of the entire image area of the photoreceptor could now be captured. However, such prior methods were still only concerned with measuring average transfer efficiency. Thus, although the RMA value obtained may be more sensitive or accurate than prior point sensors because it averages over a larger area, such sensing systems are still not fully utilizing the information that is available from the FWA sensor.

SUMMARY

There is a need for a residual mass sensor that can sense and record the two-dimensional structure (i.e., signature) of the residual mass remaining on a photoreceptor, or other substrate, surface after the transfer step in an Xerographic process.

There also is a need for a RMA sensor and measurement analysis routine that uses the two-dimensional structure of the RMA image to quantifiably distinguish between various types of transfer defects, such as for example, mottle, streaks, point-deletions, graininess, etc.

There further is the need for a closed-loop control system for a xerographic engine that can achieve improved print quality (PQ) performance and stability by taking into account the quantified levels of specific PQ defects from the residual mass signature so that a customized and appropriate feedback correction can be made. That is, depending on the type of PQ defect that is measured in the residual mass, the control routine may be different even if the same average residual mass per unit area (RMA) is present. This accounts for the fact that the same average RMA can be caused by many different types of PQ defects, each of which could require a different corrective action by the closed-loop controller.

In various exemplary embodiments, a full-width array sensor is provided that senses the residual mass left on a photoreceptor post-transfer and generates a two-dimensional image of the residual mass pattern or structure remaining on the photoreceptor. In various exemplary embodiments, the array sensor can also sense or obtain an average RMA level to determine a loss in average transfer efficiency. The cross-process width can also be partitioned such that this average RMA measurement can be separated into several smaller sub-regions (for example in two inch regions across the process). This technique would then give average RMA as measured at multiple points across the process width. Such a method would provide some degree of spatial information to the RMA measurement, thereby allowing somewhat localized corrections to be made. For example, one could separate the "inboard" and "outboard" transfer efficiency performance.

In exemplary embodiments, an array-based residual mass sensor detects and measures the two-dimensional residual mass signature left on a photoreceptor. This information is then processed and analyzed to determine the specific types of PQ defects present and optionally the quantified levels of each of these defects. Then, this information is used as feedback in a control scheme to control actuators in one or more of the transfer, development and/or image path subsystems to compensate for the specific types and levels of defect detected.

In various exemplary embodiments, by printing predefined test targets, captured images of the resultant residual mass patterns by the array-based or FWA sensor can be analyzed by appropriate signal processing or image analysis routines to identify and/or quantify the level of each type of PQ defect present.

In various exemplary embodiments, a defect analysis system is provided that includes a full-width array sensor, which can sense the two-dimensional structure of residual mass on a photoreceptor or other substrate surface, such as on an intermediate belt, and image analysis and/or signal processing tools that enable identification of one or more of a plurality of different types of print quality defects based on the sensed 2-D residual mass structure.

In yet further exemplary embodiments, the defect analysis system may also include a closed-loop control system that can adjust various xerographic process parameters (including image path parameters) based on the identification of specific defect types to improve the output image quality of the xerographic engine, such as a photocopier. That is, identification of the specific types of print quality defects (e.g., mottle, streaks, point deletions, graininess, etc.), and possibly their quantitative levels as well, are used to determine a customized corrective control action, or set of actions, to be taken by the feedback control system of the xerographic engine to remedy or compensate for the sensed defects.

BRIEF DESCRIPTION OF THE DRAWINGS

Exemplary embodiments will be described with reference to the drawings, wherein.

DETAILED DESCRIPTION OF EMBODIMENTS

Figure 1:
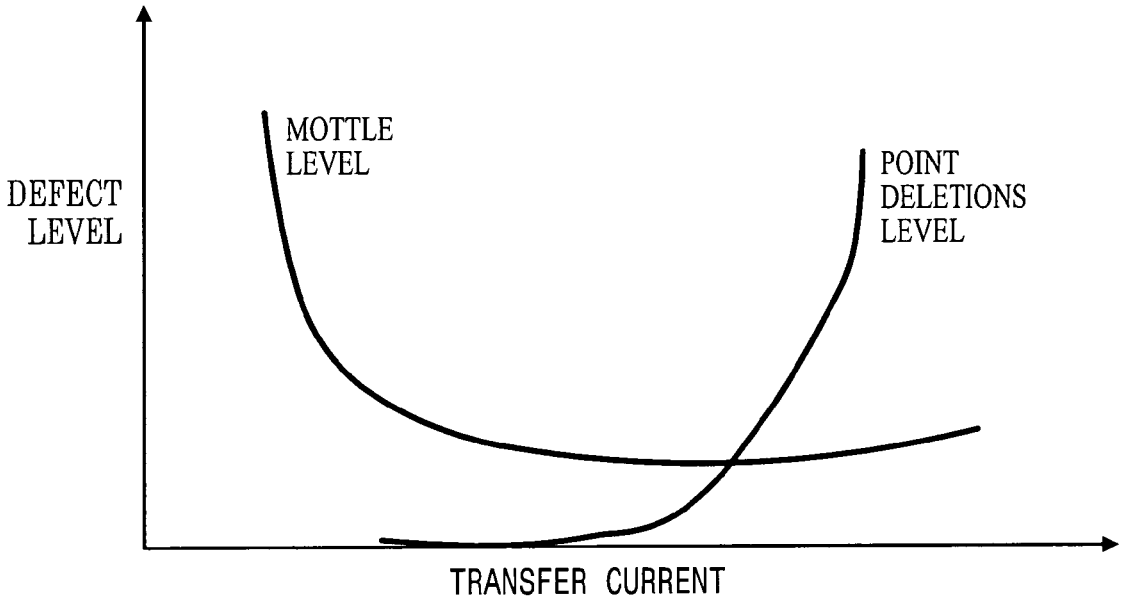
FIG. 1 illustrates a relationship between transfer current and defect levels for mottle and point deletions.

For a general understanding of the features of the present invention, reference is made to the drawings. In the drawings, like reference numerals have been used throughout to identify identical elements.

When examining transfer performance by sensing the residual mass on the photoreceptor, prior attempts looked primarily at the average mass level (i.e., residual mass per unit area (RMA)). However, changes in the average level, as well as the specific two-dimensional structure of the mass, have been found to be important to fully correct any noted print quality defects. An example of this is shown in FIG. 1, which illustrates typical curves for mottle and transfer induced point deletions in response to a transfer current actuator increase. As readily evident from the diagram, the responses of the two defects to the actuator are nearly the reverse of each other. Mottle experiences an increase in defect level at smaller transfer currents and levels off at higher transfer current levels. However, there are almost no point deletion defects at low transfer current, but a sharp rise in these defects occurs at higher transfer current levels. Thus, although at some intermediate range, levels of both are substantially minimized, both ends show extreme increases in one or the other type of defect.

From this diagram, it is apparent that knowledge of the specific type of defect that is occurring would be very important in the design of a suitable closed-loop control system to reduce defect levels in a xerographic print engine. For example, to correct a problem with transfer induced point deletions, the transfer field should be reduced. However, to correct a problem with mottle, the transfer field should be increased.

Because it is possible that both types of defects (mottle and point deletions) can exhibit the same average RMA levels, prior known ETAC or other point-sensors that sensed only average residual mass per unit area (RMA) could not distinguish between these various types of defects. Without the ability to distinguish defect type, application of a control procedure that could apply one of two opposite corrective actions was not previously possible. Because of this, prior control was very limited and, in certain circumstances, may have been detrimental to operation of the device. For example, any corrective action taken would have had to assume one type of defect and a suitable corrective action to take. If this assumption was correct, control may have worked properly. However, if this assumption was not correct, the problem could actually have been compounded due to an improper control action having been applied.

The above is particularly true when the set of actuators available to the controller is expanded beyond those in transfer alone. For example, it is possible that the detection of specific defect patterns in the residual mass pattern images could enable the adjustment of parameters in the development subsystem or even the pre-warping of images in the image path. Providing more robust residual mass sensing that can detect not only average RMA performance, but also the two-dimensional residual mass structure, can therefore enable more advanced feedback control schemes for using such actuators.

Figure 2:
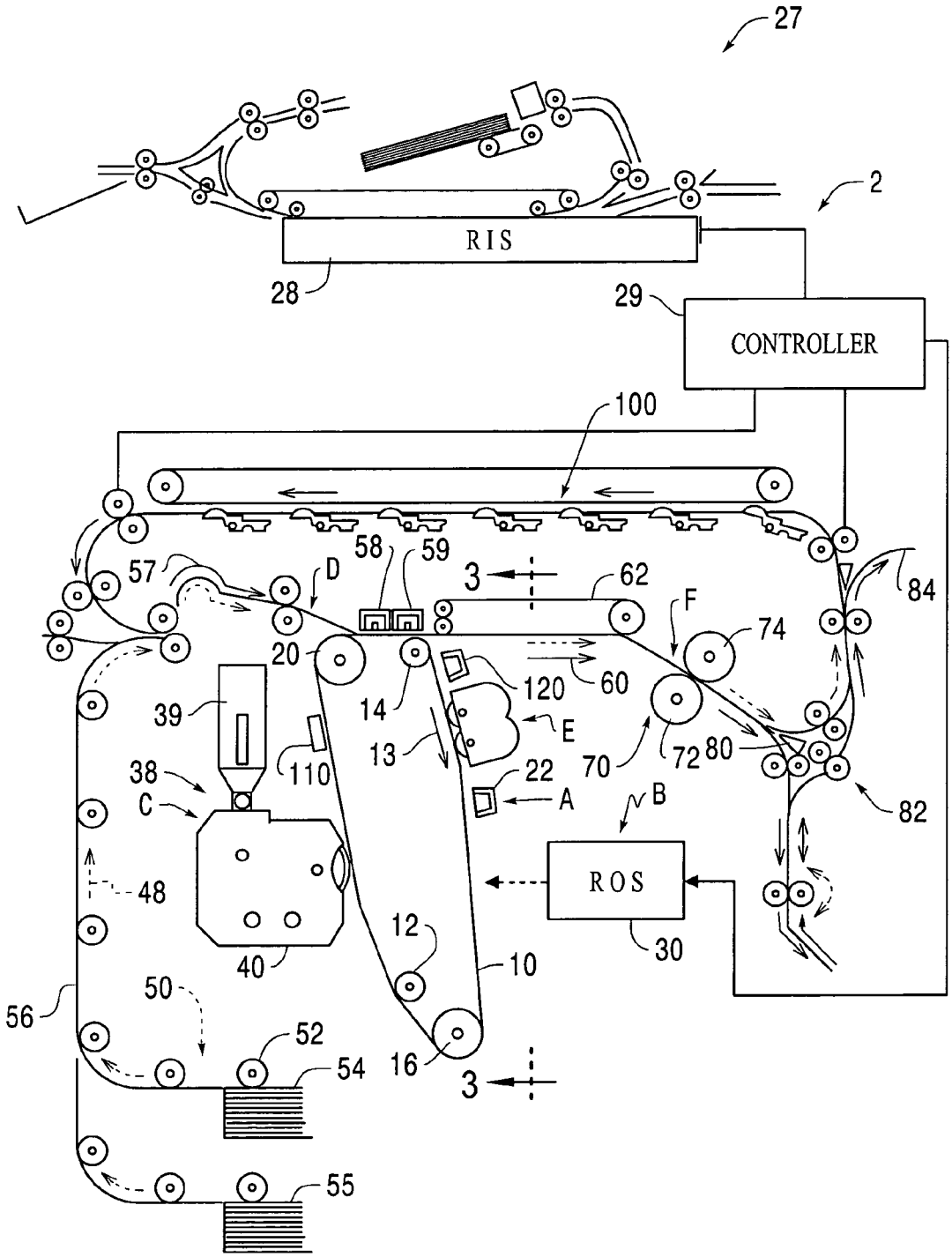
FIG. 2 illustrates a schematic of an exemplary xerographic print engine having a linear array optical sensor capable of two-dimensional (2-D) residual mass sensing in a post-transfer location upstream of a cleaning station.

FIG. 2 schematically depicts an exemplary electrophotographic (xerographic) printing machine 9 incorporating a novel two-dimensional residual mass sensor. It will become evident from the following discussion that the development system disclosed is not specifically limited in its application to the particular embodiment depicted.

Referring to FIG. 2, an original document is positioned in a document handler 27 on a raster input scanner (RIS) indicated generally by reference numeral 28. The RIS contains document illumination lamps, optics, a mechanical scanning drive and a charge coupled device (CCD) array. The RIS captures the entire original document and converts it to a series of raster scan lines. This information is transmitted to an electronic Subsystem (ESS) or controller 29 that controls a raster output scanner (ROS) 30 described below.

Electrophotographic printing machine 9 employs a photoconductive belt 10 for creating xerographic images. Preferably, the photoconductive belt 10 is made from a photoconductive material coated on a ground layer, which, in turn, is coated on an anti-curl backing layer. Belt 10 moves in the direction of arrow 13 to advance successive portions sequentially through the various processing stations disposed about the path of movement thereof. Belt 10 is entrained about idler roller 12, stripping roller 14, tensioning roller 16 and drive roller 20. As roller 20 rotates, it advances belt 10 in the direction of arrow 13.

Initially, a portion of the photoconductive surface passes through charging station A. At charging station A, a corona generating device indicated generally by the reference numeral 22 charges the photoconductive belt 10 to a relatively high, substantially uniform potential.

At an exposure station, B, a controller or Electronic Subsystem (ESS), indicated generally by reference numeral 29, receives the image signals representing the desired output image and processes these signals to convert them to a continuous tone or grayscale rendition of the image. This is transmitted to a modulated output generator, for example the raster output scanner (ROS), indicated generally by reference numeral 30. Preferably, ESS 29 is a self-contained, dedicated minicomputer. The image signals transmitted to ESS 29 may originate from a RIS as described above or from a computer, thereby enabling the electrophotographic printing machine to serve as a remotely located printer for one or more computers.

Alternatively, the printer may serve as a dedicated printer for a high-speed computer. The signals from ESS 29, corresponding to the continuous tone image desired to be reproduced by the printing machine, are transmitted to ROS 30. ROS 30 includes a laser with rotating polygon mirror block. The ROS imagewise discharges the photoconductive belt to record an electrostatic latent image thereon corresponding to the image received from ESS 29. As an alternative, ROS 30 may employ a linear array of Light Emitting Diodes (LEDs) arranged to illuminate the charged portion of photoconductive belt 10 on a raster-by-raster basis.

After the electrostatic latent image has been recorded on photoconductive belt 10, the belt advances to move the latent image to a development station C. At station C toner, in the form of dry marking particles, is electrostatically attracted to the latent image. The latent image attracts toner particles from a scavengeless developer apparatus, resulting in a toner powder image being formed on the photoconductive surface of belt 10 (photoconductive surface 10). As successive electrostatic latent images are developed, toner particles are depleted from the developer material. A toner particle dispenser, indicated generally by the reference numeral 39, on signal from controller 29, dispenses toner particles into a non-interactive development system, such as Hybrid Scavengeless Developer (HSD) system 40 of developer unit 38 available from Xerox Corporation. Developer unit 38 comprises donor roll 41 that serves to deposit toner particles on the photoconductive surface 10.

Developer system 40 may alternatively comprise a non-interactive development system comprising a plurality of electrode wires closely spaced from a toned donor roll or belt in the development zone. An AC voltage is applied to the wires to generate a toner cloud in the development zone. The electrostatic fields associated with the latent image attract toner from the toner cloud to develop the latent image. The donor roll 41 may also comprise an electrode donor roll structure such as that disclosed in U.S. Pat. No. 5,360,940 to Hays.

With continued reference to FIG. 2, after the electrostatic latent image is developed, the toner powder image present on belt 10 advances to transfer station D. A substrate 48, such as plain paper, is advanced to a transfer station D by a substrate feeding apparatus 50. Preferably, substrate feeding apparatus 50 includes a feed roll 52 contacting the uppermost substrate of stack 54. Feed roll 52 rotates to advance the uppermost substrate from stack 54 into vertical transport 56. Vertical transport 56 directs the advancing substrate 48 of support material into registration transport 57 past image transfer station D to receive an image from photoreceptor belt 10 in a timed sequence so that the toner powder image formed thereon contacts the advancing substrate 48 at transfer station D.

Transfer station D includes a corona generating device 58 that sprays ions onto the back side of substrate 48. This attracts the toner powder image from photoconductive surface 10 to substrate 48. After transfer, substrate 48 continues to move in the direction of arrow 60 by way of belt transport 62, which advances substrate 48 past transfer device 58. A detack corona device 59 positioned downstream of the transfer device 58 serves to lessen the electrostatic attraction between the substrate 48 and the belt 10 to thereby facilitate stripping of the substrate 48 from the belt in the area of the stripping roller 14.

Fusing station F includes a fuser assembly indicated generally by the reference numeral 70, which permanently affixes the transferred toner powder image to the copy substrate. Preferably, fuser assembly 70 includes a heated fuser roller 72 and a pressure roller 74 with the powder image on the copy substrate contacting fuser roller 72.

As the substrates 48 pass through fuser 70, images are permanently fixed or fused to the substrate. After passing through fuser 70, a gate 80 either allows the substrate to move directly via output 84 to a finisher or stacker, or deflects the substrate into the duplex path 100, specifically, first into single substrate inverter 82. That is, if the substrate is either a simplex substrate, or a completed duplex substrate having both side one and side two images formed thereon, the substrate will be conveyed via gate 80 directly to output 84. However, if the substrate is being duplexed and is then only printed with a side one image, the gate 80 will be positioned to deflect that substrate into the inverter 82 and into the duplex loop path 100, where that substrate will be inverted and then fed for recirculation back through transfer station D and fuser 70 for receiving and permanently fixing the side two image to the backside of that duplex substrate, before it exits via exit path 84.

After the print substrate is separated from photoconductive surface 10, any residual toner/developer and paper fiber particles adhering to photoconductive surface 10 are removed therefrom at cleaning station E. Cleaning station E includes one or more rotatably mounted fibrous brushes and a cleaning blade in contact with photoconductive surface 10 to disturb and remove paper fibers and non-transferred toner particles. The blade may be configured in either a wiper or doctor position, depending on the application. Subsequent to cleaning, a discharge lamp (not shown) floods photoconductive surface 10 with light to dissipate any residual electrostatic charge remaining thereon prior to the charging thereof for the next successive imaging cycle.

The various machine functions are regulated by controller 29. The controller is preferably a programmable microprocessor which controls all of the machine functions hereinbefore described including toner dispensing. The controller provides a comparison count of the copy substrates, the number of documents being recirculated, the number of copy substrates selected by the operator, time delays, jam corrections, etc. The control of all of the exemplary systems heretofore described may be accomplished by conventional control switch inputs from the printing machine consoles selected by the operator. Conventional substrate path sensors or switches may be utilized to keep track of the position of the document and the copy substrates.

A density sensor, such as an Extended Toner Area Coverage (ETAC) sensor 110 downstream of the developer unit 38, is used for controlling actuators within the development subsystem. Non-limiting examples of such actuators include development bias voltage, laser power, and charging voltage/current or some combination/subset of these. This sensor may be of the point type described earlier that senses developed mass per unit area (DMA) only. At some desired sampling interval, test patches are output from the development system and measured by the ETAC point sensor. These DMA readings are then used in a feedback loop to adjust the settings in the development subsystem in an effort to maintain a developed mass output that is near the desired target level.

Figure 3:
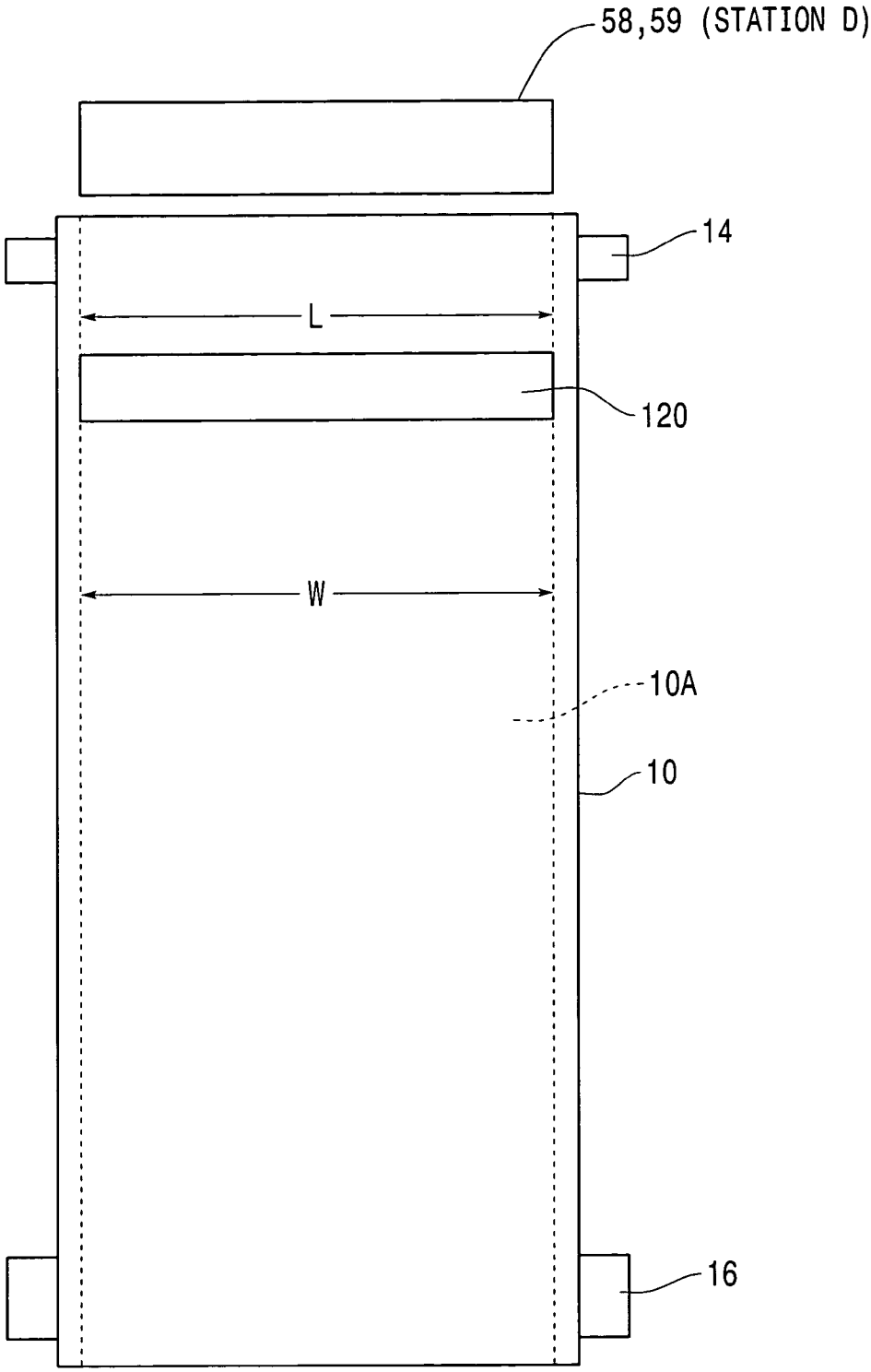
FIG. 3 illustrates a partial cross-sectional view of the xerographic print engine of FIG. 2 taken along lines 3-3 showing relevant details of the transfer station, photoconductive belt and residual mass sensor.

In order to provide improved determination of transfer defects, a residual mass sensor 120 is provided downstream of transfer station D, preferably prior to cleaning station E. In exemplary embodiments, residual mass sensor 120 is a full width array (FWA) sensor having an array length L that spans substantially the entire effective width W of the photoconductive surface 10 (i.e., the portion 10A that is capable of being imaged by the charging station A, exposure station B, and developer station C) as shown in FIG. 3. In a preferred embodiment, FWA sensor 120 is a photodiode array coupled with a lens array for focusing light onto the sensing elements as well as an illumination source. The contact image sensor (CIS) model number SV651A4C, available from Syscan, is an example of such a sensor. This sensor is constructed of 5184 sensing elements and provides a 600 samples per inch (SPI) resolution across the length of the bar. The sensor also provides an adjustable light-emitting diode (LED) illumination source capable of providing varying levels of red, green, and blue (RGB) illumination across the entire length of the sensor array. In this preferred embodiment, the LED illumination source is used to direct light onto the photoconductor surface in the post-transfer position. This incident light will then interact with the photoconductor and the residual mass pattern, with the amount of light that is scattered and/or absorbed being related to the amount of residual mass that is present on the photoconductor surface. Some of the light that is reflected from the photoconductor and/or residual mass will reach the sensor and is then gathered by the lens array and directed onto the array of sensing elements.

In a particular embodiment, the incident light from the illumination source and the photodetector array are aligned such that a completely specular reflection is obtained from the bare photoconductor surface (i.e. the incident light is reflected off the bare photoconductor at the appropriate angle so as to be directed straight into the photodetector array). This configuration provides that most of the incident light will reach the photodetector array in the case of a bare photoconductor passing beneath the sensor. In this configuration, any residual toner present on the photoconductor surface will serve mostly to scatter the incident light. Thus, the amount of mass present in a particular region can be inversely related to the amount of reflected light that a sensing element receives (with more light indicating less toner present and vice-versa). Other modes of operation are also possible, depending on the desired illuminator/detector configuration. As an example, the diffuse reflection (rather than the specular) from the photoconductor surface can be observed by the residual mass sensor.

In various exemplary embodiments, full-width array sensor 120 senses the residual mass left on a photoreceptor or other substrate surface after transfer by transfer station D and generates a two-dimensional image of the residual mass pattern or structure remaining on the photoconductive surface 10 to form a residual mass signature. In various exemplary embodiments, the full-width sensor can also sense or obtain an average residual mass per unit area (RMA) level to determine a loss in average transfer efficiency.

In the illustrated example, there is only a single transfer step. However, the invention is not limited to this. For example, in tandem engines, there are two transfer steps. A first transfer is from the photoconductor surface to an intermediate substrate (typically a belt). After all four color images are transferred to this intermediate belt, the entire image is then transferred to paper in a second transfer step. In this example, it may be desirable to sense residual mass patterns after either or both of these steps.

By printing predefined test targets, for example, captured images of the resultant residual mass patterns by the FWA sensor 120 can be analyzed by appropriate signal processing or image analysis to identify and/or quantify the level of each type of defect present on the photoconductive surface. These identified defects and possible their quantified levels can then be used as feedback in a closed-loop control system for the xerographic engine. This will enable improved performance and more robust control by taking into account identification of various types of transfer defects so that a customized and appropriate feedback correction can be made. That is, depending on the type of defect problem encountered, the control routine may be different even if the same average residual mass (RMA) is present. Details of the processing, analysis and feedback control will be described later.

In other embodiments, periodic sampling of the 2-D developed mass patterns can also be obtained using the post-transfer FWA sensor. By printing inter-document zone patterns between pages in a job stream and/or by intentionally not feeding paper and not actuating the transfer device during a pitch of the customer job, it is possible to allow developed mass images to pass undisturbed through the transfer subsystem. These mass patterns can then be detected using the post-transfer FWA sensor. Such a technique will enable substantial information about the development subsystem's performance to be obtained. This information can then be used, either in conjunction with or separately from, the information obtained by sampling the residual mass patterns to implement feedback and/or feed-forward control algorithms to ensure optimal print quality in the output pages.

It is believed that the foregoing description is sufficient for purposes of the present application to illustrate the general operation of an electrophotographic printing machine incorporating the features of the present invention therein.

Figure 4:
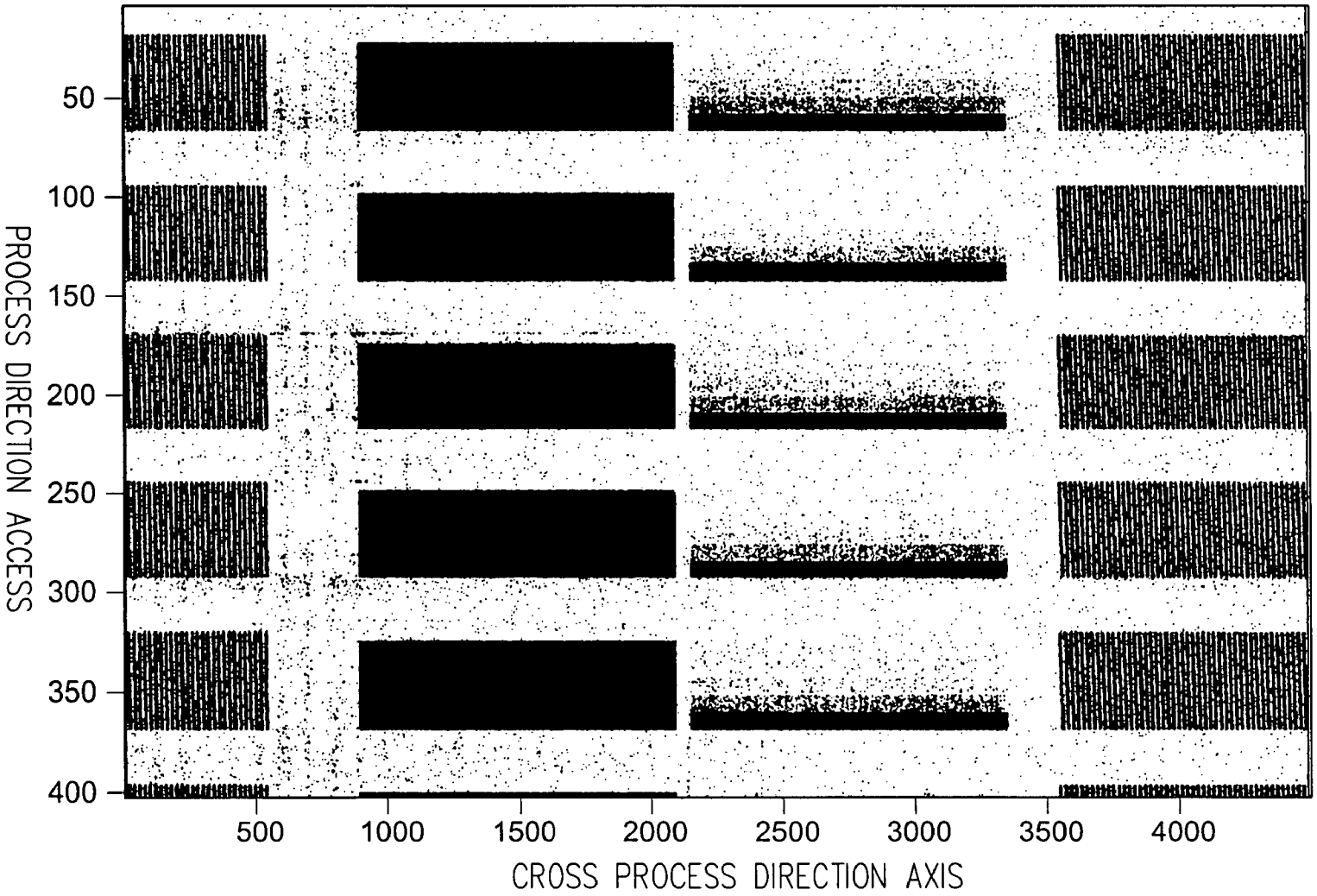
FIG. 4 illustrates an exemplary sample composite residual mass image showing the residual mass signatures of five separate pages of information.

With reference to FIG. 4, there is shown an exemplary output of an RMA sensor image taken across five panels of the photoconductive belt 10 by sensor 120. In this sample figure, the advantage of acquiring 2-D information from the residual mass patterns is clearly seen. Rather than obtaining a single voltage level as would typically be output from a point sensor such as an ETAC, 2-D structural aspects of the residual mass pattern (including the characteristics of the slanted line patterns) can be detected and analyzed. This allows for a much greater amount of information to be extracted from the residual mass signature than is typically available. In a preferred embodiment, the sensor captures the two-dimensional structure across a substantial portion of the photoconductive surface (10A) so that a significant signature of the residual mass pattern can be analyzed. In other possible embodiments, one or more smaller array sensors may be used to obtain 2-D information about the residual mass pattern over smaller regions of the photoconductive surface (10A). Thus, 2-D information, possibly at very high resolutions, can be obtained over specific regions of interest.

For the particular sensor that was used to obtain the residual mass image in FIG. 4, there was a fairly substantial difference in the sampling resolutions between the process and cross-process directions. In this case, the sensor was sampling at a much higher resolution in the cross-process dimension. This difference in sampling resolution between the two dimensions is responsible for the aspect ratio of FIG. 4, in which the cross-process dimension in the figure appears elongated as compared to the process dimension. Obviously, other sensors can be used that provide varying resolutions in both the process and cross-process dimensions. What is important is that the two dimensional structure of the residual mass pattern is captured by the sensor.

In the sample image shown in FIG. 4, there are five successive pages worth of residual mass information represented in the image. The test pattern used to generate this image consisted of a solid box next to a series of cross-process direction halftone strips in the center of the image. On the inboard and outboard sides of the test pattern was a series of parallel lines. The process direction runs parallel to the vertical axis in the figure. As can be seen from the residual mass image in this figure, there are process direction streaks occurring in the prints. Note that the streaks are, in this case, visibly persistent through multiple panels on the photoconductor belt. Information such as this may be analyzed to enable recognition, and in many cases quantification, of particular types of defects.

It can be seen that by taking a two-dimensional image of the residual mass structure, print quality errors can be visually recognized, either manually or through image quality analysis software (either offline or embedded within the machine as part of its normal operations). By performing a calibration of the sensor, it is also possible to correlate the particular residual mass signature to a particular transfer or other subsystem error and to quantify the level of defect. In an example implementation, this calibration step is achieved through comparison of the resultant printed output and the images from the residual mass sensor 120. Specific examples are discussed below.

Figure 5:
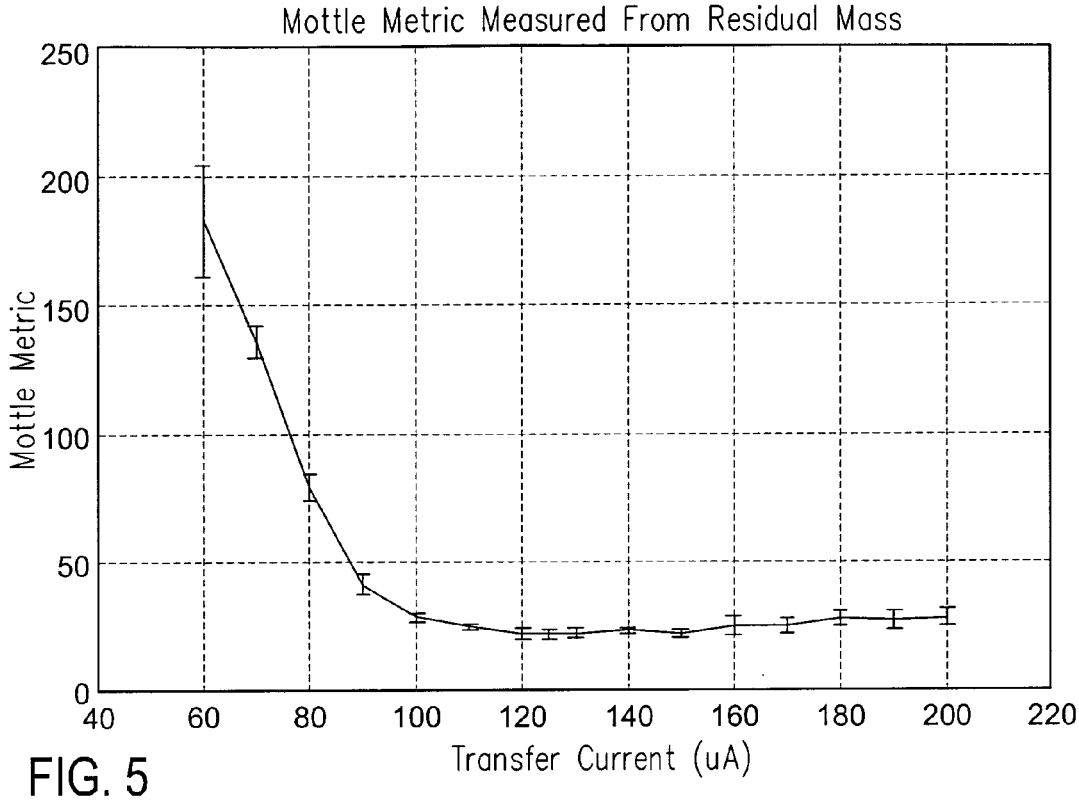
FIG. 5 illustrates a graph showing a relationship between transfer current and mottle based on 2-D residual mass signature analysis.
Figure 6:
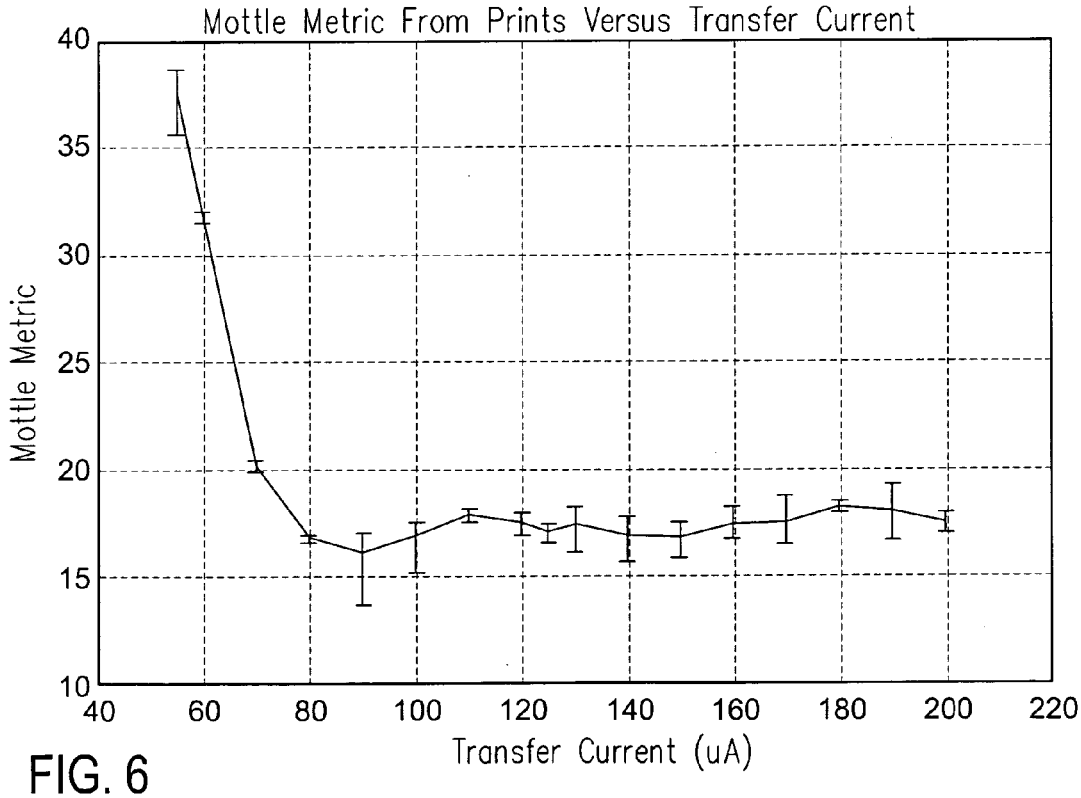
FIG. 6 illustrates a graph showing a relationship between transfer current and mottle based on image quality analysis of a corresponding output print image.
Figure 7:
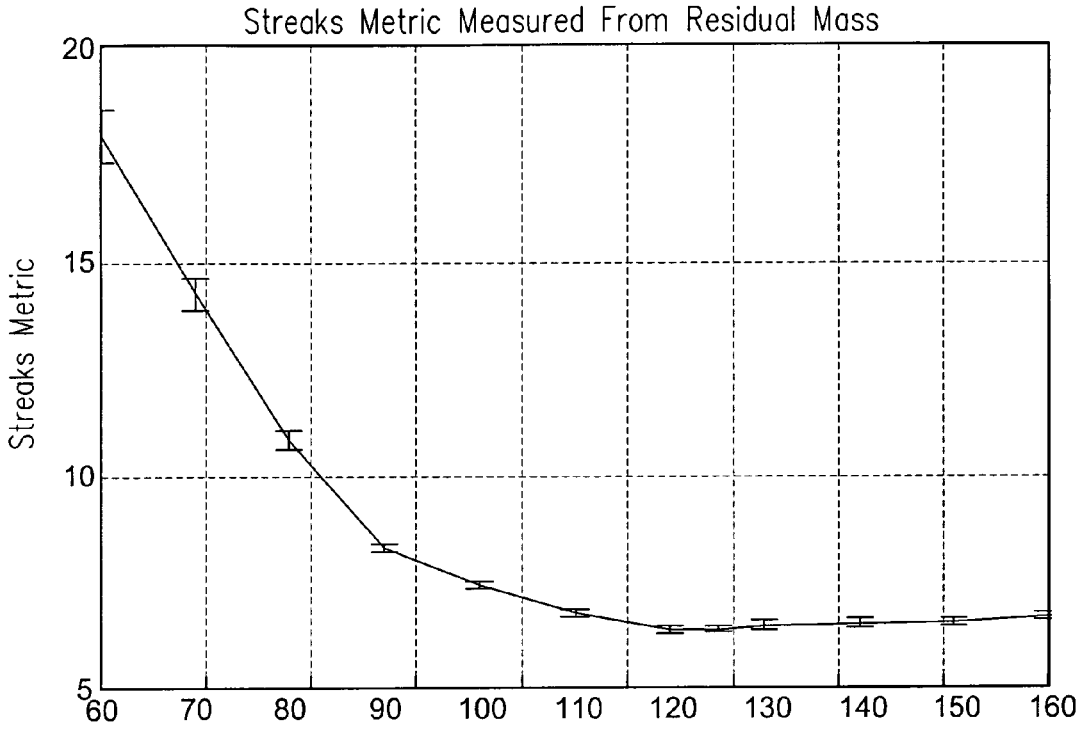
FIG. 7 illustrates a graph showing a relationship between transfer current and streaks based on 2-D residual mass signature analysis.

Experiments were conducted for both mottle and streak detection using a test xerographic print engine similar to the schematic system of FIG. 2. The graphs of FIGS. 5-8 correlate the sensor detection of streaks and mottle with that measured directly off of the output prints using standard image analysis tools. The plots in FIGS. 5 and 7 show the results of experiments where the transfer field was varied across a wide range of values to intentionally induce both mottle and streaks in test prints.

Individual residual mass signatures on the photoconductive belt 10 were then examined by an FWA sensor 120 and, through suitable post-processing of the resultant residual mass signatures, the levels of each defect were quantified. FIG. 5 shows a mottle metric from the residual mass signature showing a plot of transfer current versus mottle level. FIG. 7 shows a streak metric from the residual mass signature of transfer current versus streak level.

Figure 8:
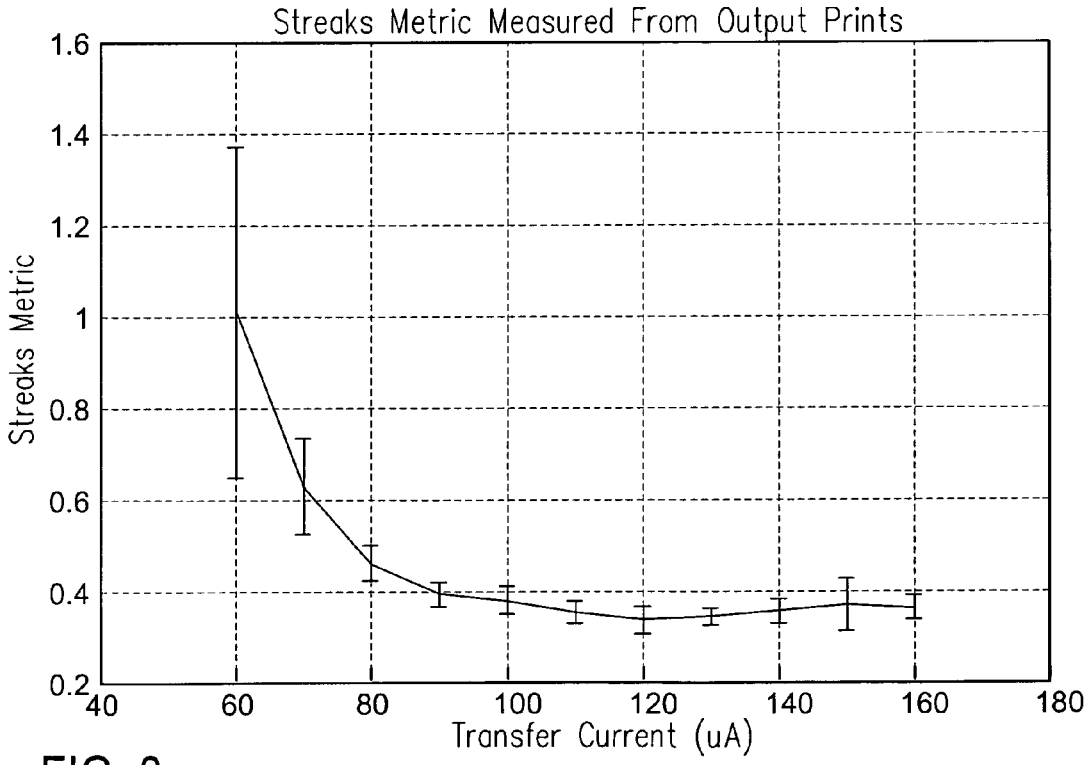
FIG. 8 illustrates a graph showing a relationship between transfer current and streaks based on image quality analysis of a corresponding output print image.

The output prints printed by the xerographic print engine were then analyzed using known conventional image quality analysis software to quantify the levels of streaks and mottle present on the output sheets. Plots of the image quality analysis on the output sheets are shown in FIGS. 6 and 8. As can be seen, the image quality metrics calculated directly from the two-dimensional residual signatures detected by the residual mass sensor 120 from the residual mass on the photoconductive surface strongly correlates with the results obtained from analysis of the output print images. Thus, it can be established that analysis of the residual mass can be used to accurately detect specific transfer defect types, as well as accurately quantify the level of defects present.

It is possible to make measurements using various test targets. Three non-limiting examples will be described. A first would be a specialty test target that is meant to enhance particular effects, such as a particular spatial frequency to detect the presence of low levels of residual mass. A second would be a more standard test pattern (such as those that one might look at visually). A third would be to take measurements off of the residual mass of the actual customer target as it is being printed. In essence, there are a variety of methods for making samples. The key is use of the 2-D nature of the sampling to measure defects of the type that one could visually identify in the prints (mottle, streaks, etc). Using this 2-D information, one can quantify the actual level of each of the various types of defects and then make a correction in the machine in an effort to prevent these defects from growing worse. Since different types of defects may require different mitigating adjustments in the machine, the 2-D detection of the level of each defect is essential to making the correct adjustments. Once particular transfer defects are detected and quantified, this information can be used as feedback to control subsequent operation of the xerographic print engine.

From experimentation with a particular xerographic print engine, it is possible to thus develop suitable algorithms for the detection and quantification of various defects for a particular device. A control diagram indicating the type of control system that this setup enables is shown below with reference to FIG. 9.

Figure 9:
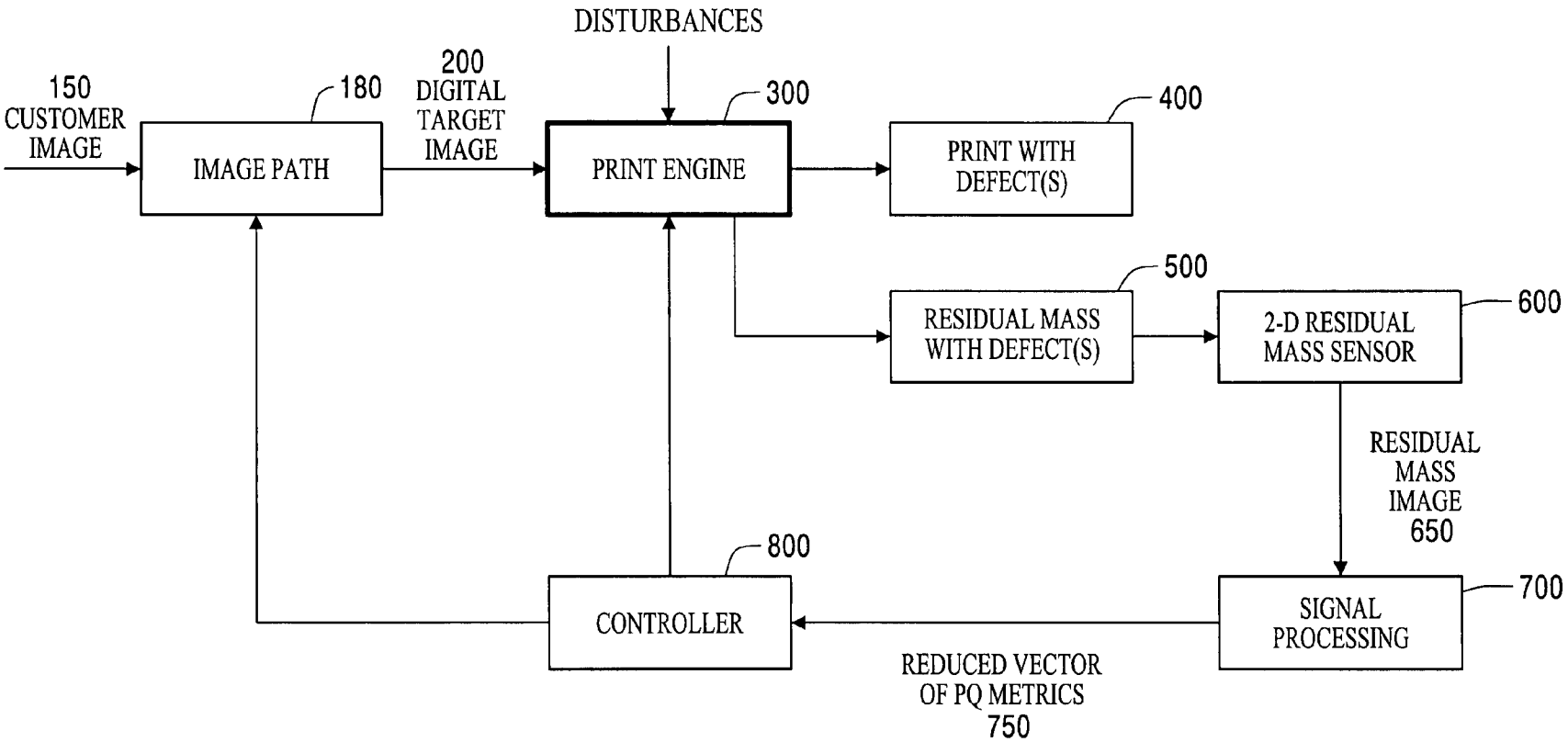
FIG. 9 illustrates a first exemplary schematic of a defect analysis system within a xerographic print engine.

In the exemplary feedback control scheme of FIG. 9, the feedback of two-dimensional information from the residual mass sensor is analyzed using signal and/or image processing algorithms to produce a reduced set of print quality (PQ) metrics. These may include, as non-limiting examples, mottle level, streaks, graininess, etc. These quantified levels of particular defects are then what enables the controller to make adjustment to appropriate actuators of the xerographic print engine that will mitigate the specific defect(s).

As shown, a customer image 150 is input into the device, such as through scanning. The input image is then manipulated through an image path 180, such as through various scanning optics and digital conversions until a desired digital target image 200 is output to print engine 300 for printing of an output print. However, because of certain unknown disturbances in the print engine 300, an output from transfer may contain one or more print defects. Here it is seen that the output of transfer is the unfused print 400 and some residual mass 500 on the photoconductive belt, both of which contain a defect. Based on the correlation between output print defect and residual mass, it can be assumed that the residual mass signature will carry a characteristic of the output defect and can be used to detect and potentially to quantify such defects. Thus, residual mass 500 on photoconductive belt containing a defect can be detected by a two-dimensional residual mass sensor 600 (corresponding to sensor 120 in FIG. 2) to obtain a two-dimensional residual mass signature 650. This signature 650 can be fed to a signal processing circuit or software 700 to detect particular types of transfer defects and optionally quantify the level of any detected defect. Signal processing circuit or software 700 can then output a reduced vector of print quality metrics 750 that are output to controller 800. Controller 800 can then adjust subsequent operation of the print engine 300 in a closed-loop fashion based on the metrics to compensate for detected print quality defects. It is possible to either measure DMA directly as described previously or to discern through various methods that a defect is in fact coming through in the developed mass image, and not caused in transfer. This would then typically require an adjustment in the image path and/or in the development subsystem.

The control loop enabled by this two-dimensional sensing is the ability to measure particular defects in the residual mass signature on the belt, thereby allowing for corrective actions to be taken that are specific to the individual defects that were detected (as well as the magnitudes of the defects).

An exemplary control algorithm uses the following control equation:

$$I_{transfer}(k)=I_{transfer}(k-1)+K_{mottle}*P_{mottle}(k-1)-K_{pd}*P_{pd}(k-1) \quad (1)$$

where $K_{mottle}$ and $K_{pd}$ are proportional gains and $P_{mottle}(k-1)$ and $P_{pd}(k-1)$ represent the levels of mottle and point deletions, respectively, that were detected in the residual mass signature of the previous print. From this equation, it is easily seen that the value of the transfer current for the present print, $I_{transfer}(k)$, is dictated by the level of each specific defect (mottle and point deletions) that occurred in the previous print. In fact, the level of each of these defects tends to drive the controller output in opposite directions.

Without the 2-dimensional sensing and specific defect detection capability, the controller 800 would not be able to target its adjustments in such a way. Thus, the feedback of 2-D information from the residual mass sensor 120 enables detection and quantification of specific print quality defects. This set of metrics can then be used in more advanced forms of feedback control than were previously possible with simple point-sensor type RMA feedback devices.

Another feedback control scheme will be described with reference to FIG. 10. As in the previous example, a customer image 150 is converted through suitable image path 180 into a target image 200 that is provided as input for producing a print 400. This target image is used by various "upstream" print engine stations, including charging station A, exposure station B and development station C (collectively upstream stations 310 that have various actuators 315 necessary for control). The collective stations 310 produce a developed mass onto the photoconductive belt that is advanced to a transfer station 320 that has various actuators 325 necessary for control. Because of incomplete or inefficient transfer, an un-fused output print 400 is produced containing a portion of the developed mass of toner, while some residual mass 500 may remain on the photoconductive surface of the belt. FWA residual mass sensor 600 senses the two-dimensional structure or signature of the residual mass (residual mass image 650) and, through suitable processing by signal processing 700, outputs various print quality defect metrics 750 to controller 800.

Figure 10:
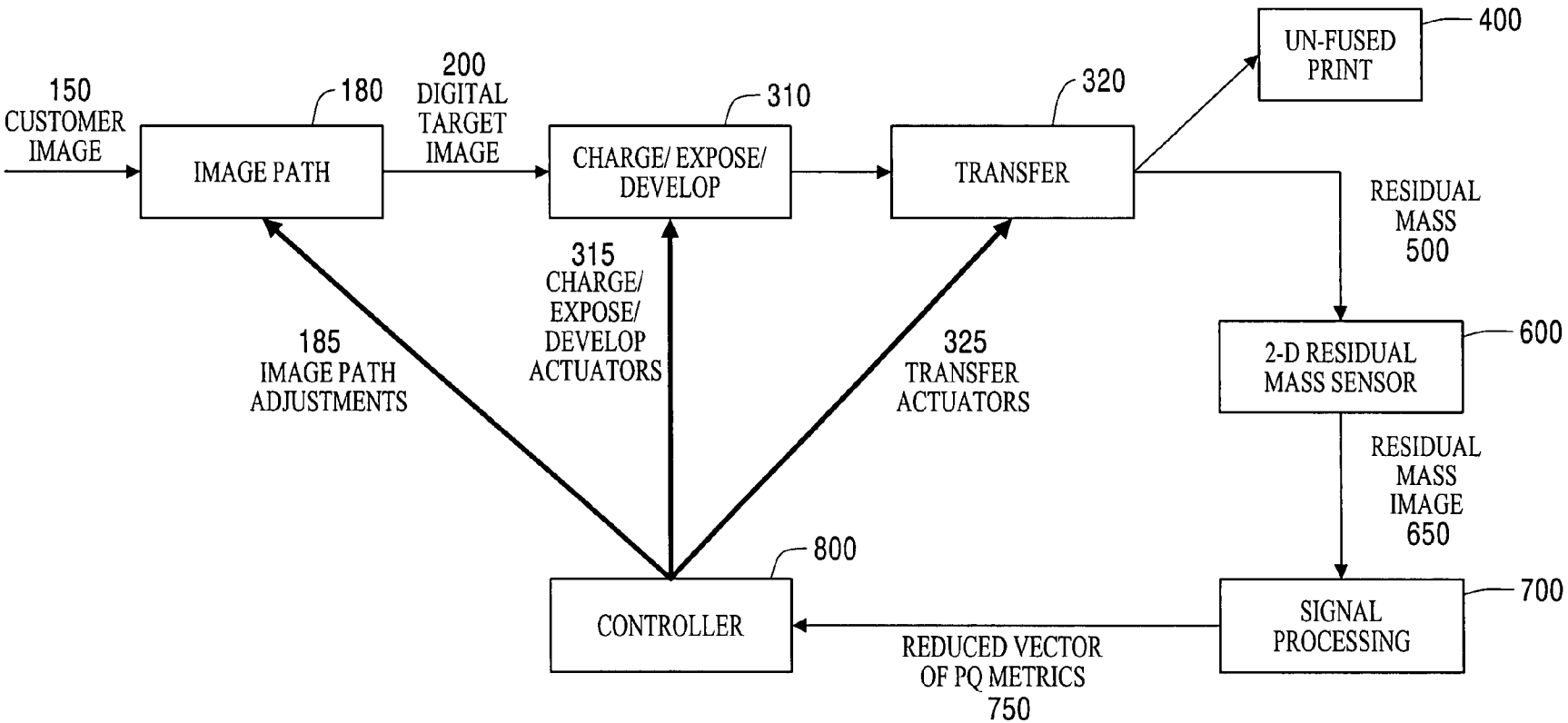
FIG. 10 illustrates a second exemplary schematic of a defect analysis system within a xerographic print engine.

As indicated in FIG. 10, the adjustments made by controller 800 need not be limited to the transfer subsystem (station 320), but might also be made to "upstream" subsystems 310 as well, such as to any of the actuators 315 that control one or more of the collective charging, exposing and developing stations, or process controls that relate to a transport subsystem that advances either the paper or photoconductive belt. In addition, adjustments can also be made directly to the digital image in the image path through control of image path adjustments 185. Non-limiting examples of image path actuators include the image tone reproduction curve (TRC), color calibration tables, and imager subsystem settings.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art which are also intended to be encompassed by the following claims.

What is claimed is:

1. A method for identifying specific transfer defects in a xerographic print engine using residual mass, comprising:

electronically sensing a two-dimensional residual mass structure on a substantial portion of a substrate surface within the xerographic print engine after image transfer;

analyzing the two-dimensional structure using signal and/or image processing techniques; and detecting a specific transfer defect, or set of defects, based on the sensed two-dimensional residual mass structure.

2. The method according to claim 1, wherein the sensing is performed using a full width array sensor that spans substantially an entire width of the substrate surface.

3. The method according to claim 1, wherein the specific defect includes at least one of mottle, streaks, graininess, or point deletions.

4. The method according to claim 1, further comprising quantifying the level of the specific transfer defect.

5. The method according to claim 4, further comprising providing feedback to the print engine to adjust a subsequent printing operation based on the specific transfer defect detected and the quantified level.

6. The method according to claim 1, further comprising providing feedback to the print engine to adjust a subsequent printing operation based on the specific transfer defect detected.

7. The method according to claim 6, further comprising obtaining the average residual mass per unit area (RMA) from the sensed residual mass.

8. The method according to claim 7, wherein when the average RMA is substantially the same for two different images, providing a first feedback to make a first adjustment for a first specific type of defect detected and providing a second feedback to make a second, different adjustment for a second, different specific type of defect detected.

9. The method according to claim 8, wherein the first specific type of defect is mottle or streaks, and the second, different specific type of defect is point deletions.

10. A xerographic print engine, comprising:

a controller that receives an image signal representing an image to be printed;

a photoconductive surface;

a charging station that charges the photoconductive surface to a relatively high potential;

an exposure station that receives image signals from the controller and records an electrostatic latent image on the photoconductive surface;

a development station that deposits toner over the electrostatic latent image on the photoconductive surface to form a toner image;

a transfer station that transfers the toner image from the photoconductive surface to a recording medium; and a residual mass sensor that senses and outputs a two-dimensional residual mass structure signature of any residual mass remaining on the photoconductive surface useful to determine and quantify specific image transfer defects, the residual mass sensor being located adjacent the photoconductive surface downstream from the transfer station in a process direction and being capable of sensing a substantial portion of the photoconductive surface.

11. The xerographic print engine according to claim 10, further comprising a signal processing routine that analyzes the output from the residual mass sensor and detects specific transfer defects based on the signature profile of the sensed two-dimensional residual mass.

12. The xerographic print engine according to claim 11, further comprising a feedback control that adjusts at least one operating parameter of the xerographic print engine based on the specific transfer defect detected.

13. The xerographic print engine according to claim 12, wherein the feedback control adjusts an actuator associated with the transfer station.

14. The xerographic print engine according to claim 12, wherein the feedback control adjusts an actuator associated with at least one processing station located upstream from the transfer station.

15. The xerographic print engine according to claim 14, wherein the upstream processing station is selected from the group consisting of the charging station, the exposure station, and the development station, and an image path.

16. The xerographic print engine according to claim 10, wherein the specific defect includes at least one of mottle, streaks, graininess or point deletions.

17. A xerographic print engine having an integrated defect analysis system, comprising:

a controller that receives an image signal representing an image to be printed;

a photoconductive surface;

a charging station that charges the photoconductive surface to a relatively high potential;

an exposure station that receives image signals from the controller and records an electrostatic latent image on a photoconductive surface;

a development station that deposits toner over the electrostatic latent image on the photoconductive surface to form a toner image;

a transfer station that transfers the toner image from the photoconductive surface to a recording medium;

a cleaning station that cleans the photoreceptive surface;

a full width array sensor located between the transfer station and the cleaning station that senses and outputs a two-dimensional residual mass structure of any residual mass remaining on the photoconductive surface;

a signal processing station that analyzes the output from the full width array sensor and detects specific transfer defects based on the signature profile of the sensed two-dimensional residual mass structure; and a feedback control that adjusts at least one operating parameter of the xerographic print engine based on at least one of type and magnitude of transfer defect detected.

18. The xerographic print engine according to claim 17, wherein the feedback control adjusts an actuator associated with the transfer station.

19. The xerographic print engine according to claim 18, wherein the feedback control adjusts a transfer current or transfer voltage applied by the transfer station.

20. The xerographic print engine according to claim 19, wherein the feedback control adjusts an actuator associated with a station other than the transfer station.

* * * * *